US007722178B2

(12) United States Patent
Taira et al.

(10) Patent No.: US 7,722,178 B2
(45) Date of Patent: May 25, 2010

(54) INK-JET HEAD

(75) Inventors: Hiroshi Taira, Ichinomiya (JP); Yoshirou Kita, Nagoya (JP); Tadanobu Chikamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 507 days.

(21) Appl. No.: 11/692,403

(22) Filed: Mar. 28, 2007

(65) Prior Publication Data

US 2007/0229635 A1 Oct. 4, 2007

(30) Foreign Application Priority Data

Mar. 31, 2006 (JP) ..... 2006-100628

(51) Int. Cl.
*B41J 2/175* (2006.01)
*B41J 2/045* (2006.01)

(52) U.S. Cl. ..... 347/93; 347/71

(58) Field of Classification Search ..... 347/68–72, 347/93
See application file for complete search history.

(56) References Cited

U.S. PATENT DOCUMENTS 7,431,444 B2 * 10/2008 Ito ..... 347/93
2004/0263570 A1 12/2004 Chikamoto
2005/0116989 A1 * 6/2005 Chikamoto ..... 347/40

FOREIGN PATENT DOCUMENTS

JP 2005-022183 A 1/2005

* cited by examiner

*Primary Examiner*—Stephen D Meier
*Assistant Examiner*—Geoffrey Mruk
(74) *Attorney, Agent, or Firm*—Baker Botts L.L.P.

(57) ABSTRACT

The passage unit is provided with a through hole that connects the ink ejection face and the support face. The ink supply block is provided with a through hole that connects the bond face and the ink inlet face. The filter film blocks communication between the through hole provided in the passage unit and the through hole provided in the ink supply block.

10 Claims, 13 Drawing Sheets

INK-JET HEAD

CROSS-REFERENCE TO RELATED APPLICATIONS

This application claims the benefit of Japanese Patent Application No. 2006-100628, filed Mar. 31, 2006, the disclosure of which is incorporated herein by reference.

BACKGROUND OF THE INVENTION

1. Field of the Invention

The present invention relates to an ink-jet head that ejects ink to a recording medium.

2. Description of Related Art

Some of ink-jet heads, which eject ink from nozzles to papers, include a passage unit and an ink supply block. Formed in the passage unit are individual ink passages each extending from a manifold channel through a pressure chamber to a nozzle formed on a lower face of the passage unit. The ink supply block supplies ink to a manifold channel of the passage unit. Each of the passage unit and the ink supply block has a layered structure of plates, and they are bonded to each other in a layered direction. An actuator unit is disposed on an upper face of the passage unit. A wire member that supplies a signal to the actuator unit extends through between the upper face of the passage unit and a lower face of the ink supply block, upward along a side face of the ink supply block. A volume of a pressure chamber included in an individual ink passage is selectively changed by means of the actuator unit, so that ejection energy is given to ink contained in the pressure chamber. Ink is accordingly ejected from a nozzle that communicates with this pressure chamber, and thus a desired image is printed on a paper.

Japanese Patent Unexamined Publication No. 2005-22183 discloses an ink-jet head in which positioning holes used in lamination of plates are formed in respective plates that constitute a passage unit and an ink supply block. These holes form through holes that extend through the passage unit and the ink supply block from their lower faces to upper faces.

SUMMARY OF THE INVENTION

In the ink-jet head disclosed in the above document, however, ink adhering to the lower face of the passage unit on which nozzles are formed may go through the through holes to the upper face of the passage unit and then further go from the lower face of the ink supply block through the through holes to the upper face of the ink supply block. As a result, ink may adhere to a wire member placed on a side face of the ink supply block, or ink may flow along the wire member and adhere to an actuator unit. This may cause electrical failure.

An object of the present invention is to provide an ink-jet head that can suppress occurrence of electrical failure.

According to an aspect of the present invention, there is provided an ink-jet head comprising a passage unit, a filter film, a piezoelectric actuator, a wire member, and an ink supply block. The passage unit is made up of a plurality of plate members laminated with each other, and includes a plurality of individual ink passages each including a pressure chamber and extending to an ink ejection port from which ink is ejected, an ink ejection face formed with a plurality of the ink ejection ports, and a support face formed with an inflow opening through which ink flows in and facing in a direction opposite to a facing direction of the ink ejection face. The filter film is attached to the support face so as to cover the inflow opening, to thereby filter ink that passes through the inflow opening. The piezoelectric actuator is attached to the support face and applies ejection energy to ink contained in the pressure chambers. The wire member is formed with a plurality of wires that are electrically connected to the piezoelectric actuator and supply an ejection signal to the piezoelectric actuator. The ink supply block is made up of a plurality of plate members laminated with each other, and includes a bond face and an ink inlet face. The bond face is formed with an outflow opening through which ink flows out, and bonded to the filter film in such a manner that the inflow opening and the outflow opening are connected through the filter film. The ink inlet face is formed with an inlet hole into which ink is injected, and faces in a direction opposite to a facing direction of the bond face. The passage unit is provided with a through hole that extends in a direction perpendicular to the ink ejection face to connect the ink ejection face and the support face. The ink supply block is provided with a through hole that extends in the direction perpendicular to the ink ejection face to connect the bond face and the ink inlet face. The filter film blocks communication between the through hole provided in the passage unit and the through hole provided in the ink supply block.

In the above aspect, ink cannot go from the ink ejection face to the ink inlet face through the through holes provided in the passage unit and the ink supply block. This can prevent ink from adhering to the piezoelectric actuator and the wire member. Consequently, occurrence of electrical failure can be suppressed.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

In the following, a certain preferred embodiment of the present invention will be described with reference to the accompanying drawings.

Figure 1:
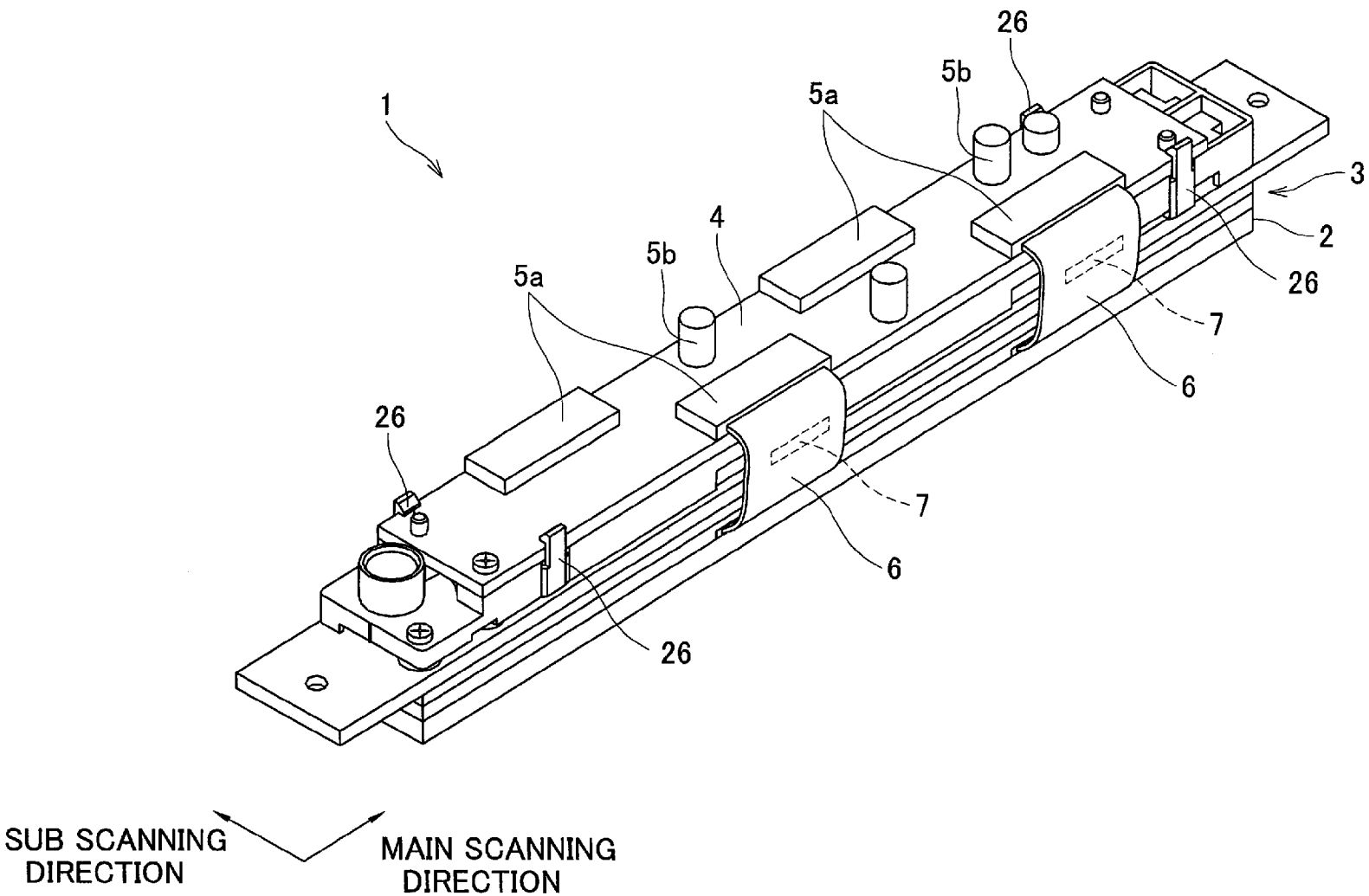
FIG. 1 is a perspective view showing appearance of an ink-jet head according to an embodiment of the present invention.

FIG. 1 is a perspective view showing appearance of an ink-jet head according to an embodiment of the present invention. As shown in FIG. 1, an ink-jet head 1 having a shape elongated in a main scanning direction includes, from a lower side in FIG. 1, a head main body 2, a reservoir unit 3, and a substrate 4. The head main body 2 is opposed to a paper. The reservoir unit 3 temporarily stores ink therein, and supplies ink to a later-described passage unit 9 (see FIG. 6) included in the head main body 2. The substrate 4 is mounted with connectors 5*a* and electronic components such as capacitors 5*b*. In the present description, a side of the ink-jet head 1 provided with the head main body 2 is defined as a lower side, and a side thereof provided with the substrate 4 is defined as an upper side.

Four actuator units 21 (see FIG. 6) are fixed onto an upper face of the head main body 2, as will be detailed later. An FPC (Flexible Printed Circuit) 6 acting as a wire member is attached onto each of the actuator units 21. The FPC 6 extends through the head main body 2 and the reservoir unit 3, upward along a side face of the reservoir unit 3. Thus, the FPC 6 has one end thereof connected to the actuator unit 21, and the other end thereof connected to a connector 5*a* of the substrate 4. In addition, a driver IC 7 is mounted on the FPC 6 midway between the actuator unit 21 and the substrate 4. That is, the FPC 6 is electrically connected to the substrate 4 and the driver IC 7, so that an image signal outputted from the substrate 4 is transmitted to the driver IC 7 and a drive signal outputted from the driver IC 7 is supplied to the actuator unit 21.

Figure 2:
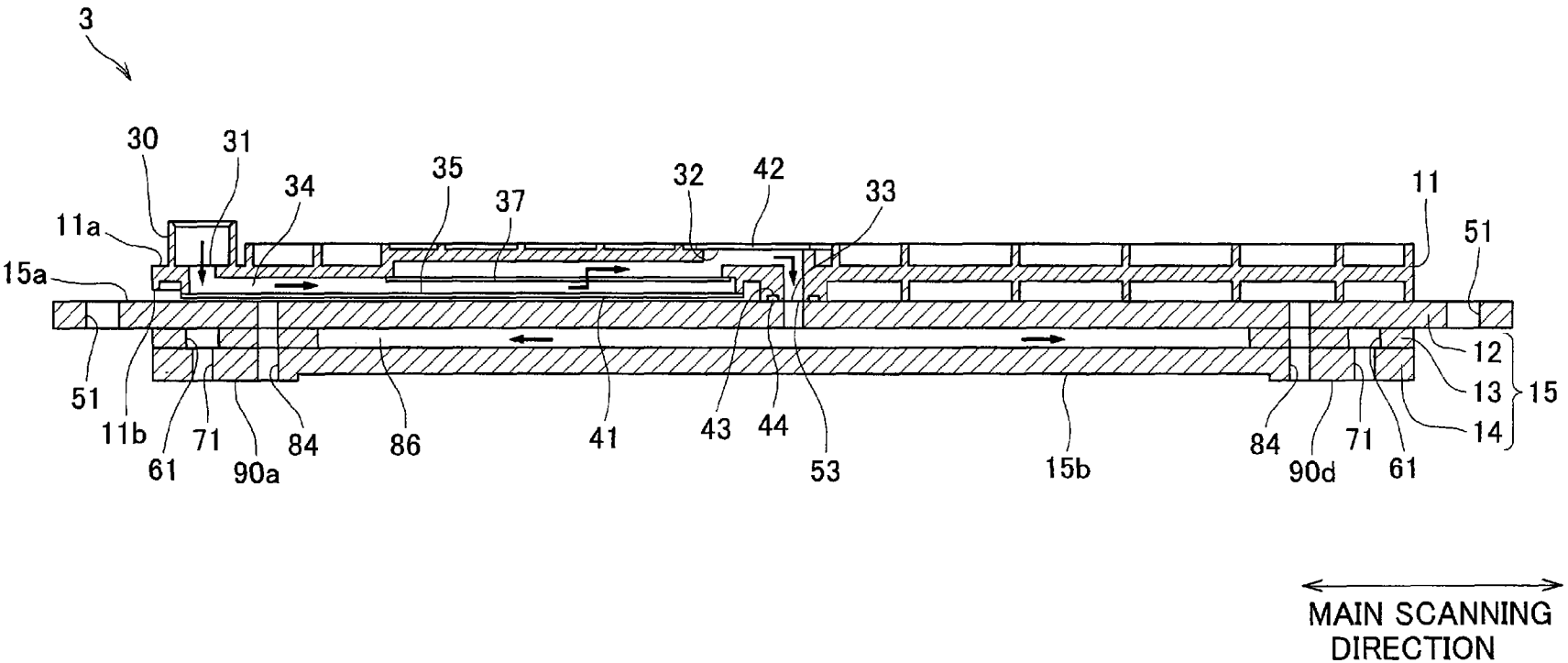
FIG. 2 is a sectional view of a reservoir unit shown in FIG. 1.
Figure 3A:
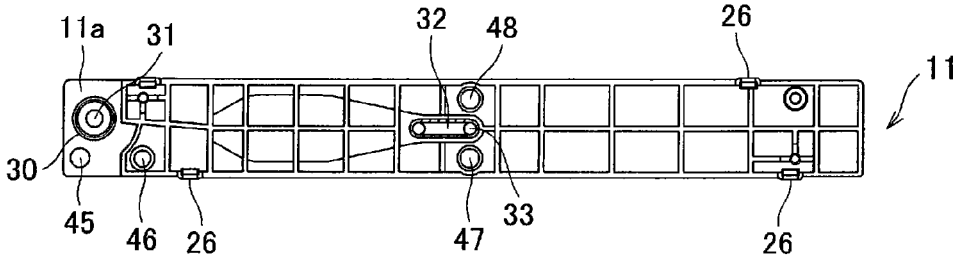
FIG. 3A is a top plan view of an ink introduction block shown in FIG. 2.
Figure 3B:
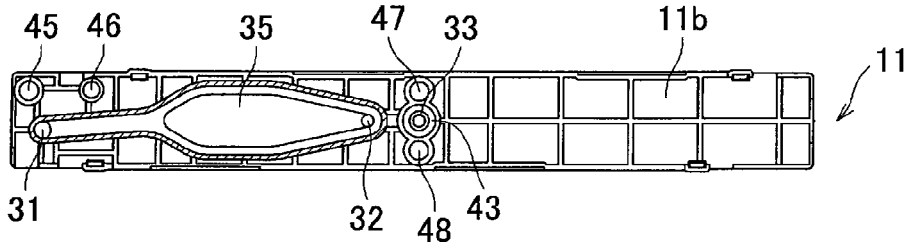
FIG. 3B is a bottom plan view of the ink introduction block shown in FIG. 2.
Figure 3C:
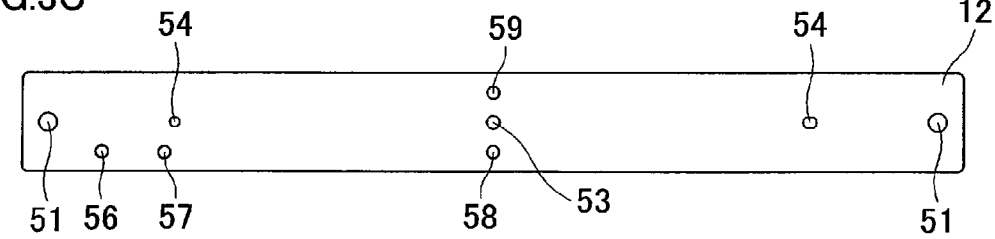
FIG. 3C is a top plan view of an uppermost plate that constitutes an ink supply block shown in FIG. 2.
Figure 3D:
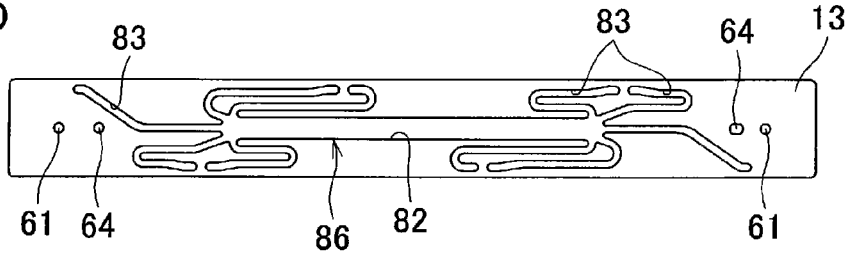
FIG. 3D is a top plan view of an intermediate plate that constitutes the ink supply block shown in FIG. 2.
Figure 3E:
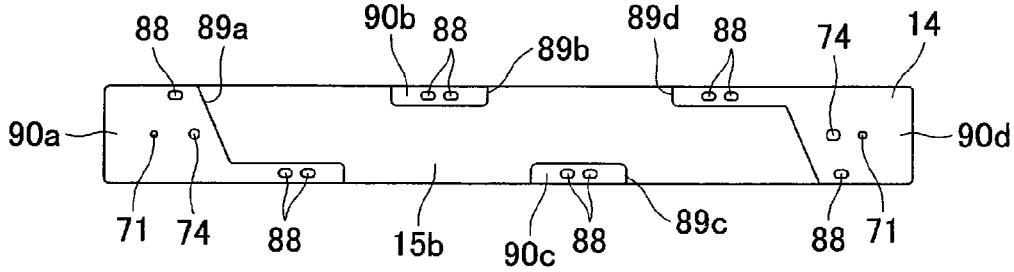
FIG. 3E is a bottom plan view of an lowermost plate that constitutes the ink supply block shown in FIG. 2.
Figure 3E:
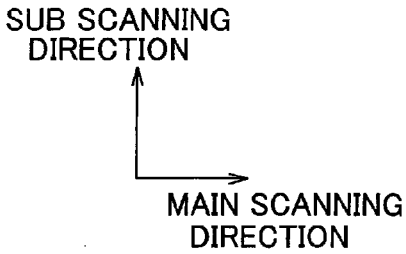
Figure 4:
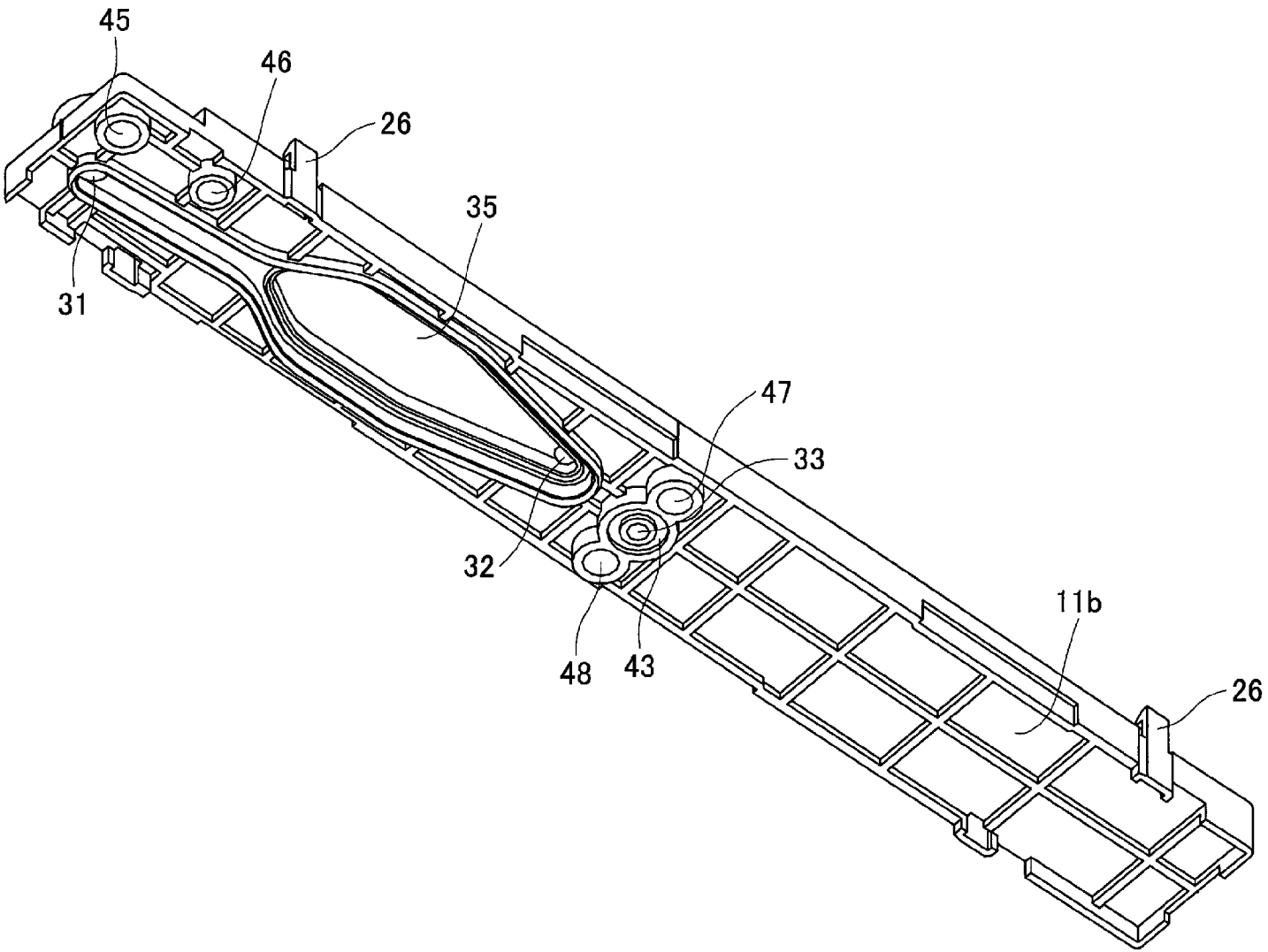
FIG. 4 is a perspective view of the ink introduction block shown in FIG. 2, as seen at an angle from below.
Figure 5:
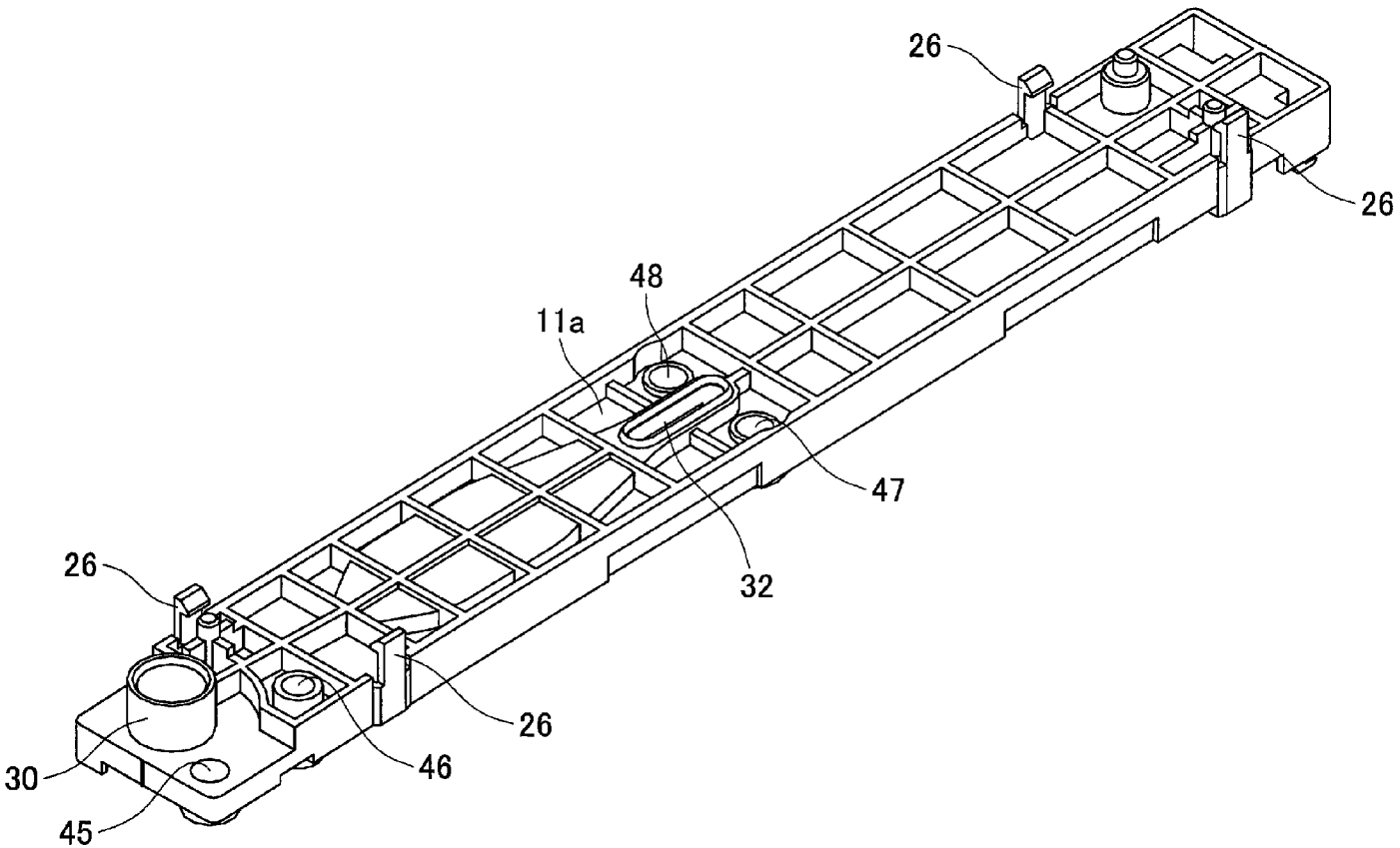
FIG. 5 is a perspective view of the ink introduction block shown in FIG. 2, as seen at an angle from above.

FIG. 2 is a sectional view of the reservoir unit 3 shown in FIG. 1. For the purpose of explanatory convenience, FIG. 2 is drawn to an enlarged scale in the vertical direction. FIGS. 3A to 3E are exploded plan views of the reservoir unit 3 shown in FIG. 1. Here, both FIGS. 3A and 3B show an ink introduction block 11 that constitute a part of the reservoir unit 3. FIG. 3A is a top plan view and FIG. 3B is a bottom plan view. FIGS. 3C and 3D are top views of plates 12 and 13, respectively, that constitute a part of the reservoir unit 3. FIG. 3E is a bottom view of a plate 14 that constitutes a part of the reservoir unit 3. FIG. 4 is a perspective view of the ink introduction block 11 shown in FIG. 2, as seen at an angle from below. FIG. 5 is a perspective view of the ink introduction block 11 shown in FIG. 2, as seen at an angle from above. In order to make a structure of the ink introduction block 11 easy to understand, illustrations of a film 41, a film 42, and a filter 37 which will de described later are omitted from FIGS. 3A to 5.

As shown in FIGS. 3A to 3E, the reservoir unit 3 has a layered structure laminated with an ink introduction block 11 and three plates 12 to 14. The ink introduction block 11 is elongated in the main scanning direction. Each of the three plates 12 to 14 has a rectangular plane elongated in the main scanning direction. As shown in FIG. 2, the plates 12 to 14 as laminated with each other serve as an ink supply block 15. Here, the plates 12 to 14 are metal plates made for example of a stainless steel or the like.

The uppermost ink introduction block 11 is made of a synthetic resin such as a polyacetal resin and a polypropylene resin for example. As shown in FIG. 2, an upper reservoir passage 34 is formed inside the ink introduction block 11. The upper reservoir passage 34 makes communication between an inlet 31 and an outlet 33. The inlet 31 is provided on an upper face 11*a* of the ink introduction block 11, near one longitudinal end portion thereof, i.e., a left end portion in FIG. 2. The outlet 33 is provided on a lower face 11*b* of the ink introduction block 11, at a longitudinal center thereof. Thus, the upper reservoir passage 34 is formed only in a portion of the ink introduction block 11 between the center and the one end with respect to an extending direction of the ink introduction block 11. A tubular joint 30 is formed on the upper face 11*a* of the ink introduction block 11. The tubular joint 30 surrounds the inlet 31 and protrudes upward. A connection member is connected to the joint 30. The connection member is coupled to an end of a not-shown ink supply tube that is connected to a not-shown ink tank. Thus, ink is supplied from the ink tank through the joint 30 to the upper reservoir passage 34.

As shown in FIGS. 3A and 5, an elliptical opening 32 is formed on the upper face 11*a* of the ink introduction block 11. The opening 32 is elongated along a longitudinal direction of the ink introduction block 11. The opening 32 is formed in a region of the upper face 11*a* opposed to where the upper reservoir passage 34 is formed. One longitudinal end, which means a right end in FIGS. 2 and 3A, of the opening 32 is opposed to the outlet 33 that is formed on the lower face 11*b*. As shown in FIG. 2, the opening 32 is sealed with the film 42. Further, as shown in FIGS. 3B and 4, an opening 35 extending in the main scanning direction is formed on the lower face 11*b* of the ink introduction block 11. The opening 35 is formed in a region stretching from a portion opposed to the inlet 31 that is formed on the upper face 11*a* to a portion opposed to a vicinity of the other end of the opening 32 that is formed on the upper face 11*a*. The other end of the opening 32 is opposite to the one end thereof opposed to the outlet 33. As shown in FIG. 2, the opening 35 is sealed with the film 41.

Like this, due to the film 41 that seals the opening 35 and the film 42 that seals the opening 32, the ink introduction block 11 is formed with the upper reservoir passage 32 extending from the inlet 31 that locates at the one longitudinal end portion of the ink introduction block 11 to the outlet 33 that locates at the longitudinal center of the ink introduction block 11. As shown in FIG. 2, in a region of the upper reservoir passage 34 existing between a substantially central portion with respect to an extending direction of the upper reservoir 34 and a portion at which ends of the respective openings 35 and 32 are opposed to each other, a depth of the upper reservoir passage 34, which means a length of the upper reservoir passage 34 with respect to an up-and-down direction in FIG. 2, is expanded upward. A filter 37 is provided in this deeper region. In this way, ink supplied from the ink tank flows through the inlet 31 into the upper reservoir passage 34, passes through the filter 37, and then flows out through the outlet 33.

Here, the films 41 and 42 that seal the openings 35 and 32, respectively, are made of a flexible material having an excellent gas barrier property, such as a PET (polyethylene terephthalate) film that is vapor-deposited with a silica film (SiOx film) or an aluminum film. Accordingly, air existing outside the ink-jet head 1 can hardly go through the films 41 and 42 into the upper reservoir passage 34 of the ink introduction block 11.

On the lower face 11*b* of the ink supply block 11, an annular groove 43 is formed around the outlet 33. An O-ring 44 is fitted in the annular groove 43, so that the outlet 33 and an inlet hole 53 are in water-tight communication with each other. As will be described later, the inlet hole 53 is formed in the plate 12. As shown in FIGS. 3A and 3B, four through holes 45 to 48 are formed through the ink introduction block 11 from the upper face 11*a* to the lower face 11*b*. The through holes 45 to 48 are for screwing the ink introduction block 11 to the plate 12.

As shown in FIGS. 3A and 5, two hooks 26 protruding upward are formed at each end of the ink introduction block 11 with respect to the sub scanning direction. The hooks 26 are formed on an outer peripheral side face of the ink introduction block 11. The hooks 26 are for holding and maintaining an upper face of the substrate 4 which will be disposed on the ink introduction block 11.

As shown in FIGS. 2 and 3C, through holes 51 are formed at both longitudinal end portions, with respect to the sub scanning direction, of the uppermost plate 12 of the ink supply block 15. The through holes 51 are used for fixing the ink-jet head 1 to a printer main body by means of screws. The plate 12 also has, at its center, a through hole that is connected to the inlet hole 53 formed on the upper face of the plate 12. The plate 12 further has reference holes 54 at its portions a little closer to the center than the through holes 51 are. The reference holes 54 are used for positioning the plates when assembling the plates. The plate 12 further has four screw holes 56 to 59. The four screw holes 56 to 59 correspond to the four through holes 45 to 48 of the ink introduction block 11 described above. By screwing the ink introduction block 11 and the plate 12 to each other, the outlet 33 of the ink introduction block 11 and the inlet hole 53 of the plate 12 get opposed to each other, to make communication between the upper reservoir passage 34 and the through hole of the plate 12 connected to the inlet hole 53.

As shown in FIGS. 2 and 3D, the intermediate plate 13 of the ink supply block 15 has a through hole that serves as a lower reservoir passage 86. The lower reservoir passage 86 includes a main passage 82 and ten branch passages 83 communicating with the main passage 82. The main passage 82 has a substantially elliptical shape elongated in a longitudinal direction of the plate 13. A center of the main passage 82 is opposed to the inlet hole 53 of the plate 12. A passage width of the branch passage 83 is smaller than a passage width of the main passage 82. Any of the branch passages 83 extends from a longitudinal end of the main passage 82 to a widthwise end portion of the plate 13. The plate 13 further has reference holes 64 each corresponding to each of the respective reference holes 54 of the plate 12, and relief holes 61 each locating between each reference hole 64 and each longitudinal end of the plate 13. The relief holes 61 are used in assembling the passage unit 9 and the ink supply block 15 to each other. In such an assembly step, an insertion pin 99 standing on a stationary assembly plate (see FIG. 13C) makes positioning as will be described later. At this time, a distal end of the insertion pin 99 locates within the relief hole 61.

As shown in FIG. 3E, the lowermost plate 14 of the ink supply block 15 has through holes that are connected to respective outflow openings 88. The outflow openings 88, each of which has a substantially elliptical shape in a plan view, are formed on a lower face of the plate 14 at positions opposed to ends of the respective branch passages 83. That is, every outflow opening 88 is formed at widthwise end portion of the plate 14. Portions of the lower face of the plate 14 surrounding the outflow openings 88 protrude, and form protrusions 89*a*, 89*b*, 89*c*, and 89*d*. In this embodiment, the protrusions 89*a* to 89*d* of the plate 14, as well as the through holes connected to the outflow openings 88, are formed by an etching process. Bond faces 90*a* to 90*d* of the protrusions 89*a* to 89*d*, which are the lower face of the plate 14, are fixed to filter films 95*a* and 95*b* that are disposed on a support face 9*a*, i.e., an upper face, of the passage unit 9, as will be described later. Consequently, a portion of the lower face of the plate 14 except the bond faces 90*a* to 90*d* is an opposing face 15*b* that is spaced apart from the support face 9*a* of the passage unit 9. Thus, a predetermined space is formed between the opposing face 15*b* and the support face 9*a*. The above-described FPC 6 extends through this space. In addition, the plate 14 has positioning holes 71 and reference holes 74 that correspond to the relief holes 61 and the reference holes 64 formed in the plate 13, respectively.

By inserting insertion pins 97 (see FIG. 13A) into the two reference holes 54, the two reference holes 64, and the two reference holes 74, which are formed in the plates 12, 13, and 14, respectively, the three plates 12 to 14 are positioned with one another. At this time, as shown in FIG. 2, the relief holes 61 formed in the plate 13 communicate with the positioning holes 71 formed in the plate 14. Here, all the reference holes 54, 64, and 74 formed in the respective plates 12 to 14 have the same diameter. A diameter of the relief hole 61 is larger than a diameter of the positioning hole 71 that corresponds to the relief hole 61. The plates 12 to 14 are fixed to each other with an adhesive, thus forming the ink supply block 15. As shown in FIG. 2, due to the reference holes 54, 64, and 74 formed in the respective plates 12 to 14, through holes 84 appear in the ink supply block 15. The through holes 84 extend in a direction of lamination of the plates 12 to 14, from the bond faces 90*a* and 90*d* which are the lower face of the ink supply block 15 to an ink inlet face 15*a* which is an upper face of the ink supply block 15. Further, by screwing the ink introduction block 11 and the ink supply block 15 to each other, to form the reservoir unit 3.

Next, a description will be given to how ink flows within the reservoir unit 3 when ink is supplied. In FIG. 2, black arrows indicate a flow of ink within the reservoir unit 3.

Ink having flown from the not-shown ink tank into the joint 30 as described above passes through the inlet 31, the upper reservoir passage 34, and the outlet 33 of the ink introduction block 11, and then flows through the inlet hole 53 of the plate 12 into the lower reservoir passage 86 of the plate 13. That is, ink is filtered through the filter 37 provided in the upper reservoir passage 34, and then flows into the lower reservoir passage 86. In the main passage 82 of the lower reservoir passage 86, ink makes stream toward both longitudinal ends of the reservoir unit 3. At both ends of the main passage 82, ink branches into the respective branch passages 83 and flows to the outflow openings 88 of the plate 14. The outflow openings 88 are in communication with inflow openings 101 that are formed in the passage unit 9 as will be described later, so that ink is supplied into the passage unit 9.

Like this, a series of ink passages such as the upper reservoir passage 34 and the lower reservoir passage 86 is formed in the reservoir unit 3, and acts as an ink reservoir that temporarily stores ink therein.

Figure 6:
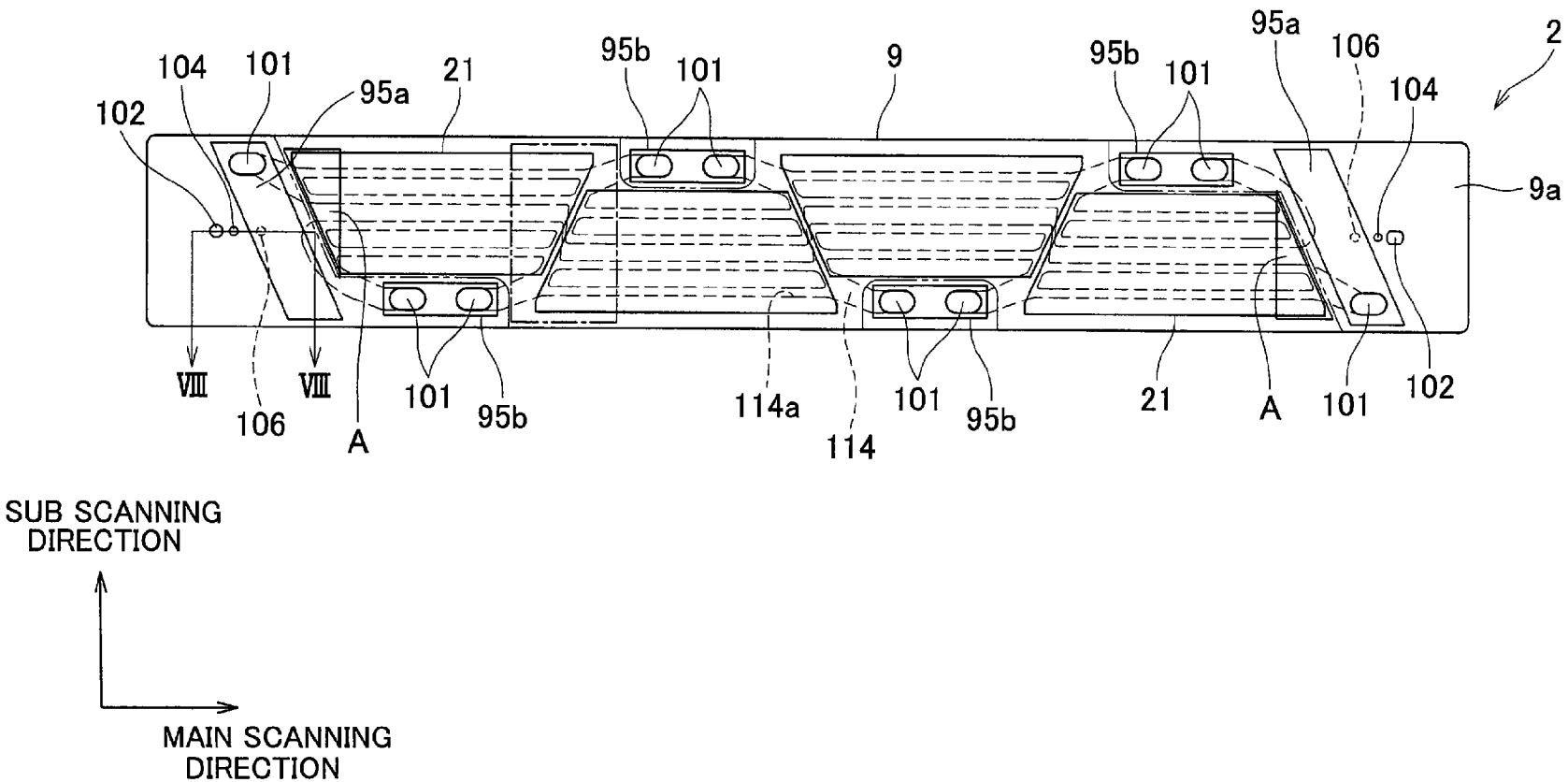
FIG. 6 is a plan view of a head main body shown in FIG. 1.
Figure 7:
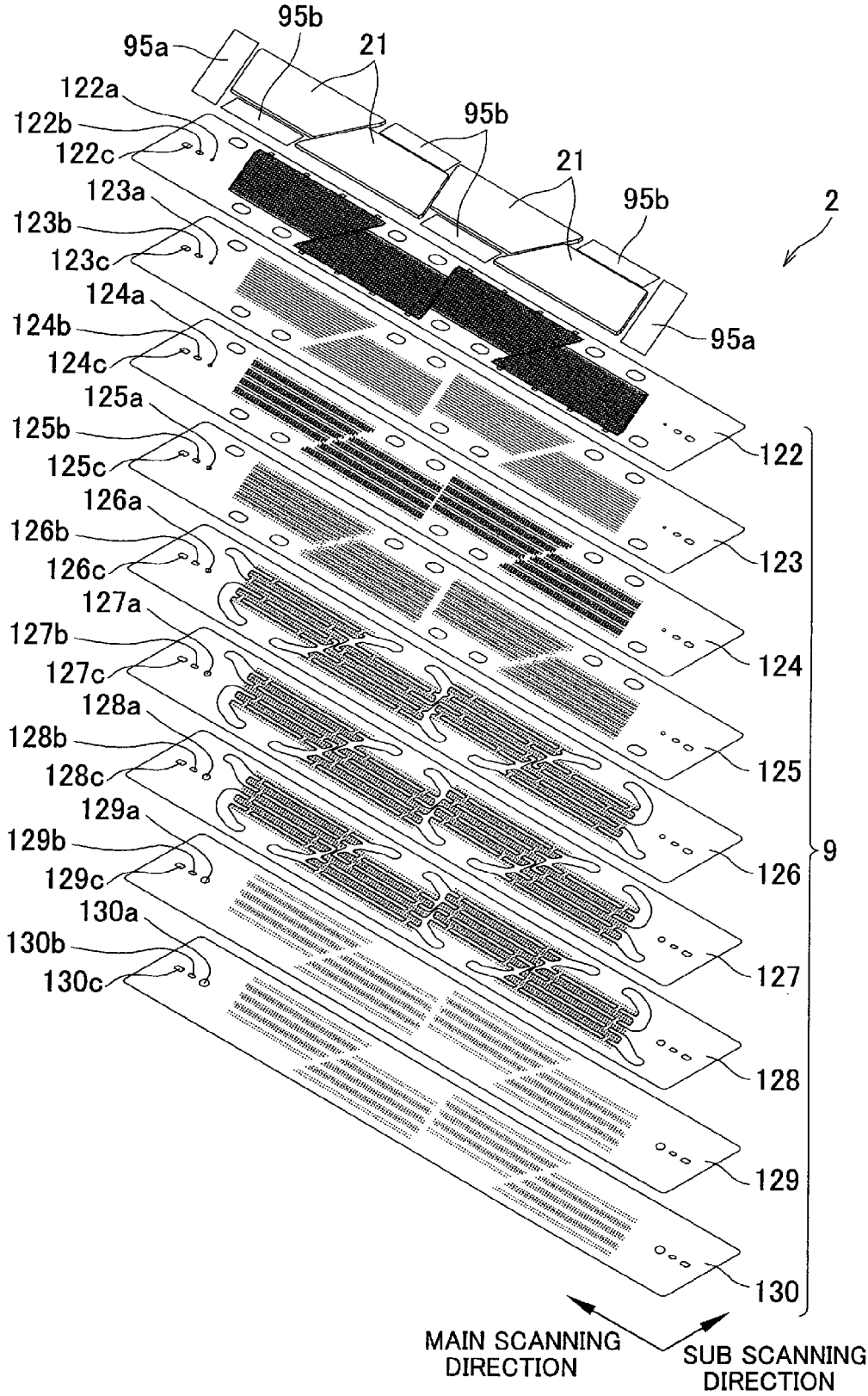
FIG. 7 is an exploded perspective view of the head main body shown in FIG. 6.
Figure 8:
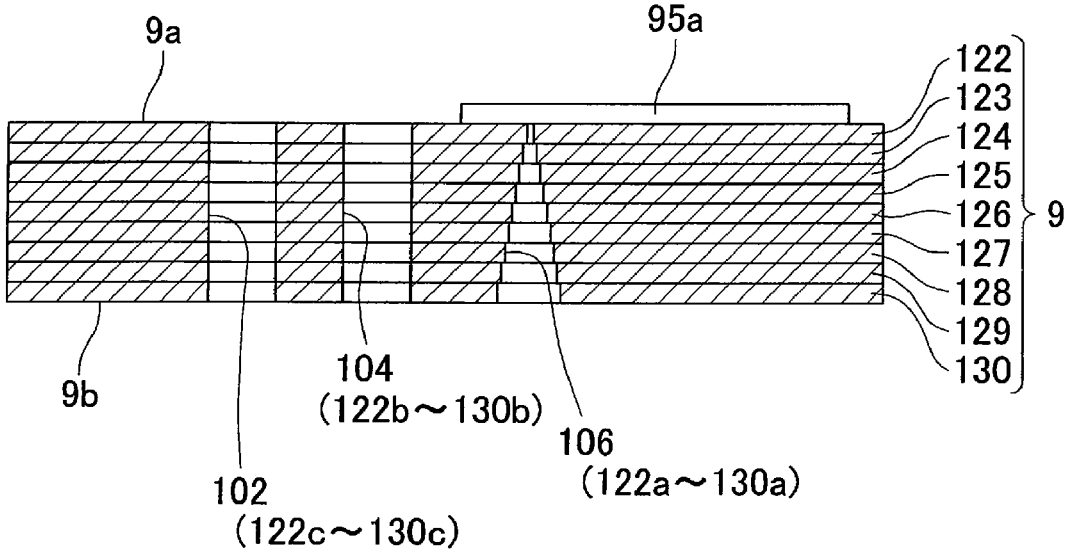
FIG. 8 shows a partial cross section as taken along line VIII-VIII in FIG. 6.
Figure 9:
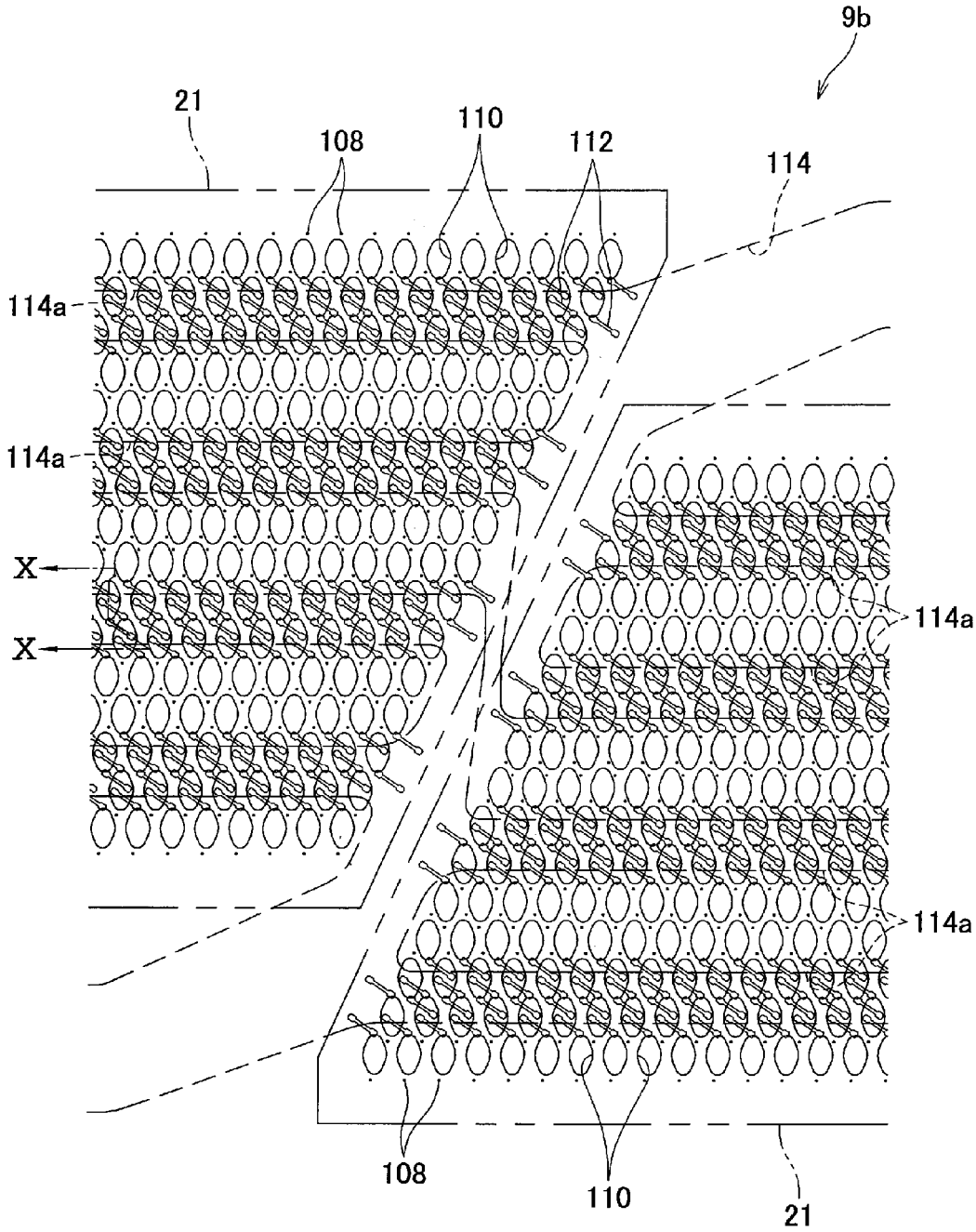
FIG. 9 shows on an enlarged scale a region enclosed by an alternate long and short dash line in FIG. 6.
Figure 10:
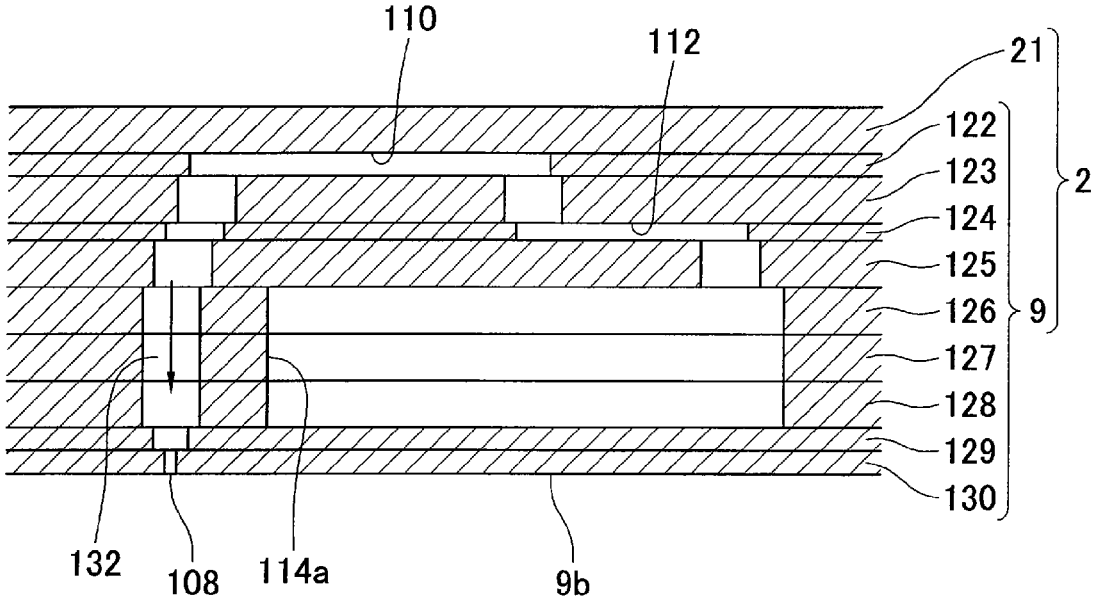
FIG. 10 shows a partial cross section as taken along line X-X in FIG. 9.
Figure 11:
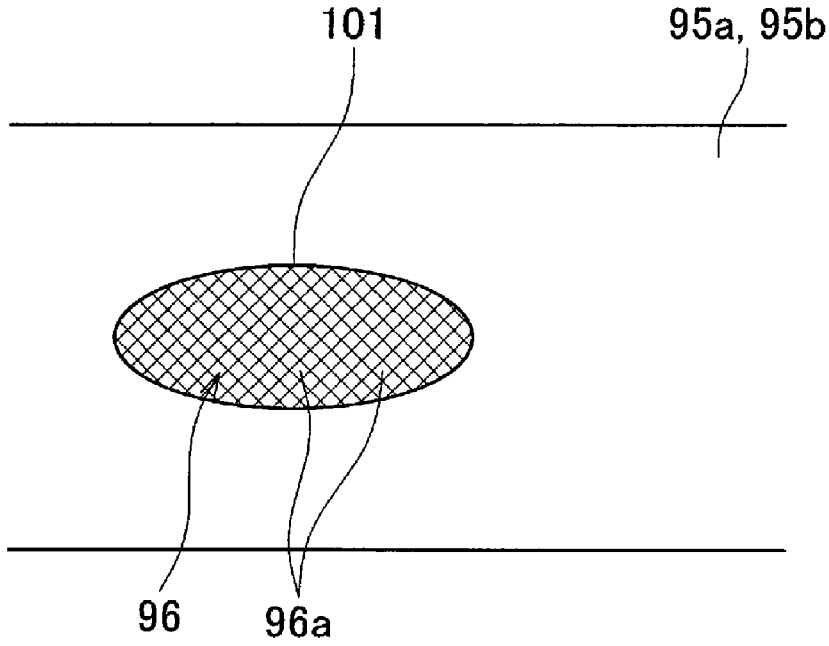
FIG. 11 shows a part of a filter film shown in FIG. 6, on an enlarged scale.
Figure 12A:
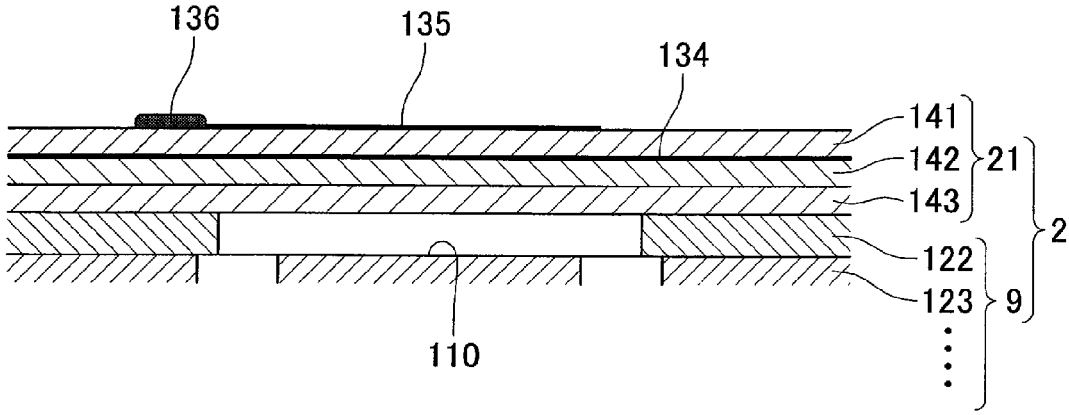
FIG. 12A shows a cross section of an actuator unit shown in FIG. 6, on an enlarged scale.
Figure 12B:
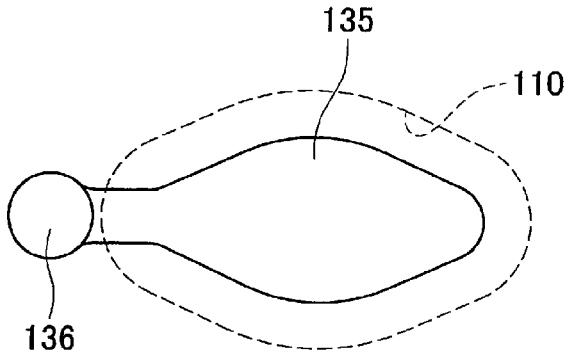
FIG. 12B is a plan view of an individual electrode that is disposed on a surface of the actuator unit in FIG. 12A.

Next, the head main body 2 will be described with reference to FIGS. 6 to 12B. FIG. 6 is a plan view of the head main body 2. FIG. 7 is an exploded perspective view of the head main body 2 shown in FIG. 6. FIG. 8 shows a partial cross section as taken along line VIII-VIII in FIG. 6. FIG. 9 shows on an enlarged scale a region enclosed by an alternate long and short dash line in FIG. 6. In FIG. 9, for the purpose of explanatory convenience, pressure chambers 110, apertures 112, and nozzles 108 are illustrated with solid lines although they locate below the actuator units 21 and therefore should actually be illustrated with broken lines. FIG. 10 shows a partial cross section as taken along line X-X in FIG. 9. FIG. 11 shows on an enlarged scale a part of a filter film shown in FIG. 6. FIG. 12A shows a cross section of the actuator unit 21 on an enlarged scale. FIG. 12B is a plan view of an individual electrode that is disposed on a surface of the actuator unit 21 in FIG. 12A.

As shown in FIG. 6, the head main body 2 includes the passage unit 9, four actuator units 21, and filter films 95*a* and 95*b*. The four actuator units 21, and filter films 95*a* and 95*b* are fixed to the support face 9*a* of the passage unit 9.

The passage unit 9 has a rectangular parallelepiped shape that is, in a plan view, substantially the same as a shape of the plate 14 of the reservoir unit 3. As described above, a total of ten inflow openings 101 communicating with the outflow openings 88 of the ink supply block 15 are formed on the support face 9*a* of the passage unit 9. As shown in FIG. 6, five of the inflow openings 101 are formed at each widthwise end portion of the passage unit 9. To be more specific, at each widthwise end portion, two pairs of adjacent inflow openings 101 and one isolated inflow opening 101 are disposed at substantially regular intervals along a longitudinal direction of the passage unit 9. The pairs of inflow openings 101 and the isolated inflow openings 101, which are disposed at both widthwise end portions, are not opposed to one another with respect to a widthwise direction of the passage unit 9. The isolated inflow opening 101 formed at one widthwise end portion, i.e., at a lower end portion in FIG. 6, is situated at one longitudinal end portion, i.e., at a right end portion in FIG. 6, and the isolated inflow opening 101 formed at the other widthwise end portion, i.e., at an upper end portion in FIG. 6, is situated at the other longitudinal end portion, i.e., at a let end portion in FIG. 6.

An ink ejection face 9*b* which means a lower face of the passage unit 9 provides, in its region opposed to where each actuator unit 21 is bonded, an ink ejection region in which many nozzles 108 are arranged in a matrix as shown in FIG. 9. The ink ejection face 9*b* is perpendicular to a direction of lamination of the reservoir unit 3 and the passage unit 9. As shown in FIGS. 6 and 9, manifold channels 114 and sub manifold channels 114*a* are formed inside the passage unit 9. The manifold channel 114 is a common ink chamber, and communicates with the inflow opening 101. The sub manifold channel 114*a* is a branch passage of the manifold channel 114. Connected to the sub manifold channel 114*a* are individual ink passages 132 each including a pressure chamber 110 and communicating with each nozzle 108 (see FIG. 10). The individual ink passages 132 are formed in a region opposed to where each actuator unit 21 is bonded. Thus, ink flows from the inflow openings 101 into the manifold channels 114, the sub manifold channels 114*a*, and the individual ink passages 132.

In the region opposed to where each actuator unit 21 is bonded, many pressure chambers 110 are arranged in a matrix. In this embodiment, as shown in FIG. 9, sixteen pressure chamber rows, in each of which pressure chambers 110 are arranged at regular intervals in the longitudinal direction of the passage unit 9, which means a horizontal direction in FIG. 9, are disposed in parallel to each other with respect to the widthwise direction of the passage unit 9, which means an up-and-down direction in FIG. 9. The number of pressure chambers 110 included in each pressure chamber row is, in conformity with an outer shape of the actuator unit 21, which is a trapezoidal shape as will be described later, gradually reduced from a longer side to a shorter side of the actuator unit 21. Nozzles 108 are arranged in the same manner, too.

As shown in FIGS. 7 and 10, the passage unit 9 is made up of nine plates of, from the top, a cavity plate 122, a base plate 123, an aperture plate 124, a supply plate 125, manifold plates 126, 127, 128, a cover plate 129, and a nozzle plate 130. Like the plates 12 to 14 of the reservoir unit 3, the respective plates 122 to 130 are metal plates made of a stainless steel or the like. In this embodiment, the plates 122 to 130 are made of SUS. Each of the plates 122 to 130 has a rectangular plane elongated in the main scanning direction.

Formed in the cavity plate 122 are many substantially rhombic through holes serving as pressure chambers 110. Formed in the aperture plate 124 are through holes serving as apertures 112. The apertures function as throttles, and communicate with the respective pressure chambers 110 through connection holes formed in the base plate 123. Formed in the manifold plates 126, 127, and 128 are through holes that are, when the plates are in layers, combined with each other to form manifold channels 114 and sub manifold channels 114*a*. The manifold channels 114 communicate with the inflow openings 101 formed on the support face 9*a*, through connection holes formed in the plates 122 to 125. The sub manifold channels 114*a* communicate with the apertures 112 through connection holes formed in the supply plate 125. Formed in the nozzle plate 130 are holes serving as nozzles 108. The nozzles 108 communicate with the respective pressure chambers 110 through connection holes formed in the plates 123 to 129.

The nine plates 122 to 130 are positioned, laminated, and fixed to one another so as to form, within the passage unit 9, individual ink passages 132 each extending from an outlet of a sub manifold channel 114*a* through an aperture 112 and a pressure chamber 110 to a nozzle 108 as shown in FIG. 10. Positioning of the respective plates 122 to 130 is performed using lamination check holes 122*a* to 130*a* and reference holes 122*b* to 130*b* (see FIG. 7), which will be detailed later.

As shown in FIG. 7, three kinds of holes, which mean the lamination check holes 122*a* to 130*a*, the reference holes 122*b* to 130*b*, and the positioning holes 122*c* to 130*c* are formed at both longitudinal end portions of the respective plates 122 to 130. The three kinds of holes 122*a* to 130*a*, 122*b* to 130*b*, and 122*c* to 130*c* are arranged along a longitudinal direction of the respective plates 122 to 130. When the plates 122 to 130 are in layers, the three kinds of holes 122*a* to 130*a*, 122*b* to 130*b*, and 122*c* to 130*c* respectively form three through holes 102, 104, and 106 at both longitudinal end portions of the passage unit 9 (see FIG. 6). The three through holes 102, 104, and 106 align along the longitudinal direction of the passage unit 9.

As shown in FIG. 8, any of the three through holes 102, 104, and 106 extends through the passage unit 9, from the upper face or the support face 9*a* to the lower face or the ink ejection face 9*b*. Among the three through holes 102, 104, and 106, the middle through hole 104 is made up of the reference holes 122*b* to 130*b* that are formed in the plates 122 to 130. The reference holes 122*b* to 130*b* are used for positioning the plates 122 to 130 in assembling the passage unit 9. That is, all of the reference holes 122*b* to 130*b* have the same diameter, and an insertion pin 98 (see FIG. 13B) is inserted through the reference holes 122*b* to 130*b*. The plates 122 to 130 are fixed to each other with an adhesive, to form the passage unit 9. By positioning and laminating the plates 122 to 130 with each other using these reference holes 122*b* to 130*b*, the other two through holes 102 and 106 are formed.

Among the three through holes 102, 104, and 106, through hole 106 closest to a longitudinal center of the passage unit 9 is made up of the lamination check holes 122*a* to 130*a* that are formed in the plates 122 to 130. As shown in FIG. 8, among the lamination check holes 122*a* to 130*a*, the one formed in the cavity plate 122 which is the uppermost plate in the passage unit 9 has the smallest diameter. The lower plate a lamination check hole is formed in, the larger diameter the lamination check hole has. The lamination check hole formed in the nozzle plate 130 which is the lowermost plate has the largest diameter. The lamination check holes 122*a* to 130*a* are used in laminating the plates 122 to 130, for making a fine adjustment after rough positioning is made using the reference holes 122*b* to 130*b*. As a result of the fine adjustment, the lamination check holes 122*a* to 130*a* that will form the through hole 106 are positioned substantially coaxially.

Among the three through holes 102, 104, and 106, the through hole 102 placed opposite to the through hole 106 across the middle through hole 104 is made up of the positioning holes 122*c* to 130*c* that are formed in the plates 122 to 130. The through hole 102 is used for positioning the passage unit 9 and the ink supply block 15 with each other. All the positioning holes 122*c* to 130*c* have the same diameter. The through hole 102 is formed at a position corresponding to the relief hole 61 and the positioning hole 71 of the plates 13 and 14 of the ink supply block 15, respectively. The through hole 102 has the same diameter as that of the positioning hole 71. By inserting an insertion pin 99 (see FIG. 13C) through the relief hole 61, the positioning hole 71, and the through hole 102, the passage unit 9 and the ink supply block 15 are positioned with each other.

As described above, the three through holes 102, 104, and 106 are formed at the both longitudinal end portions of the passage unit 9. Therefore, for laminating the plates 122 to 130 which will constitute the passage unit 9, the insertion pins 98 are inserted through the two through holes 104. For assembling the passage unit 9 and the ink supply block 15 to each other, the insertion pins 99 are inserted through the two through holes 102 and two positioning holes 71 that correspond to the two through holes 102.

Filter films 95*a* and 95*b* that covers the inflow openings 101 are disposed on the support face 9*a* of the passage unit 9. As shown in FIG. 11, many filter holes 96*a* are formed in a region of the filter films 95*a* and 95*b* opposed to the inflow opening 101, to thereby provide a filter region 96 capable of filtering ink which will be supplied through the inflow openings 101 into the passage unit 9. The filter holes 96*a* are not formed in a region not opposed to the inflow opening 101.

As shown in FIG. 6, the filter film 95*a* covers the isolated inflow opening 101 that is situated at each longitudinal end portion of the passage unit 9. The filter film 95*a* is disposed between a longitudinal end of the passage unit 9 and, among the four actuator units 21 fixed to the support face 9*a*, the actuator unit 21 closest to this longitudinal end. The filter film 95*a* slants across a width of the passage unit 9, and extends up to the both widthwise end portions of the passage unit 9. A region of the filter film 95*a* other than the filter region 96 covers the through hole 106 positioned closest to the longitudinal center of the passage unit 9. The through holes 102 and 104 are not covered with the filter film 95*a*. However, even if ink adhering to the ink ejection face 9*b* comes up to the support face 9*a* through the through holes 102 and 104, the ink cannot reach a region where the actuator units 21 exist because the filter film 95*a* is extending up to the both widthwise end portions on the support face 9*a*. The filter films 95*b* extend along the longitudinal direction of the passage unit 9, and cover four pairs of adjacent inflow openings 101.

That is, the total number of the filter plates 95*a* and 95*b* is six. As illustrated with alternate long and two short dashes lines in FIG. 6, the filter plates 95*a* and 95*b* are disposed in regions opposed to the respective protrusions 89*a* to 89*d* that are formed on the plate 14 of the reservoir unit 3. The filter films 95*a* and 95*b* are bonded with adhesive to the bond faces 90*a* to 90*d* of the protrusions 89*a* to 89*d*. When bonded to the bond faces 90*a* and 90*d*, the filter films 95*a* cover lower openings of the through holes 84 that are formed in the ink supply block 15 (see FIG. 13C).

As described above, each of the actuator units 21 is disposed in opposition to the region where pressure chambers 110 and nozzles 108 are formed. The actuator unit 21 includes actuators each opposed to each pressure chamber 110, and has a function of giving ejection energy to ink contained within the pressure chambers 110.

As shown in FIG. 6, in a region of the support face 9*a* between the filter films 95*a* disposed at the both longitudinal end portions, the four actuator units 21 each having a trapezoidal shape in a plan view are arranged in a zigzag pattern so as to keep out from the inflow openings 101. More specifically, the actuator units 21 are arranged in the longitudinal direction of the passage unit 9, with parallel opposed sides of each actuator unit 21 extending along the longitudinal direction. Oblique sides of every neighboring actuator units 21 overlap each other with respect to the widthwise direction of the passage unit 9.

Since each actuator unit 21 has a trapezoidal outer shape as described above, regions causing no ink ejection appear at both outermost end portions of a set of the four actuator units 21 with respect to the main scanning direction. The regions causing no ink ejection are nonprint regions situated outside a print region in which printing on a recording medium is performed. Regions A shown in FIG. 6 correspond to these regions. As shown in FIG. 6, the print region where the respective actuators are disposed is situated in a center, and the nonprint regions which are continuous with the print region serve to separate regions where the through holes 106 and the like are formed from the print region. Consequently, the actuator units 21 are not easily affected by ink intrusion.

As described above, the ink supply block 15 is, by means of the protrusions 89*a* to 89*d*, fixed to the filter films 95*a* and 95*b* disposed on the passage unit 9. Therefore, the opposing face 15*b* of the ink supply block 15 and the support face 9*a* of the passage unit 9 are spaced apart at an interval corresponding to a protruding height of the protrusions 89*a* to 89*d* and a thickness of the filter films 95*a* and 95*b*. In this interval, the actuator units 21 are disposed. The FPC 6, which is fixed on the actuator unit 21, is not in contact with the opposing face 15*b* of the ink supply block 15 that is opposed to the FPC 6.

The actuator unit 21 is a unimorph type actuator, and as shown in FIG. 12A made up of three piezoelectric sheets 141, 142, and 143 each having a thickness of approximately 15 μm and made of a lead zirconate titanate (PZT)-base ceramic material with ferroelectricity. The piezoelectric sheets 141 to 143 are disposed so as to extend over many pressure chambers 110 that are formed corresponding to one ink ejection face.

On the uppermost piezoelectric sheet 141, individual electrodes 135 are formed at positions opposed to the respective pressure chambers 110. The individual electrode 135 has a thickness of approximately 1 μm. A common electrode 134 having a thickness of approximately 2 μm is interposed between the uppermost piezoelectric sheet 141 and the piezoelectric sheet 142 disposed under the uppermost piezoelectric sheet 141. The common electrode 134 is formed over an entire surface of the sheet. Both of the individual electrodes 135 and the common electrode 134 are made of a metal material such as an Ag—Pd-base one for example. No electrode is disposed between the piezoelectric sheets 142 and 143.

In a plan view, as shown in FIG. 12B, the individual electrode 135 has a substantially rhombic shape that is substantially the same as a shape of the pressure chamber 110. As shown in FIGS. 12A and 12B, one acute portion of the substantially rhombic individual electrode 135 extends out to a location not opposed to the pressure chamber 110, and a circular land 136 is provided on an end of this extending-out portion. The land 136 has a diameter of approximately 160 μm, and is electrically connected to the individual electrode 135. The land 136 is made for example of gold including glass frits. Each land 136 is electrically bonded to a contact, i.e., a lead wire, provided on the FPC 6 (see FIG. 1).

In a region not illustrated, the common electrode 134 is grounded. As a consequence, the common electrode 134 is, at its portions corresponding to all the pressure chambers 110, equally kept at the ground potential.

Here, a mode of driving the actuator unit 21 will be described. The piezoelectric sheet 141 is polarized in its thickness direction. When an individual electrode 135 is set at a potential different from a potential of the common electrode 134, an electric field in a polarization direction is applied to the piezoelectric sheet 141. As a result, a portion of the piezoelectric sheet 141 to which the electric field is applied acts as an active portion which is distorted by a piezoelectric effect. That is, the piezoelectric sheet 141 extends or contracts in its thickness direction, and contracts or extends in a plane direction by a transversal piezoelectric effect. The other two piezoelectric sheets 142 and 143 form inactive layers not including a region sandwiched between an individual electrode 135 and the common electrode 134, and therefore cannot deform by themselves.

When difference occurs between plane-direction distortion of a portion of the piezoelectric sheet 141 to which the electric field is applied and plane-direction distortion of the lower piezoelectric sheets 142 and 143, the piezoelectric sheets 141 to 143 as a whole deform protrudingly toward a pressure chamber 110, i.e. that is cause unimorph deformation. This reduces a volume of the pressure chamber 110, so that ink is ejected from a nozzle 108. Then, when the individual electrode 135 is set at the same potential as the potential of the common electrode 134, the piezoelectric sheets 141 to 143 restore the original flat shape, and the volume of the pressure chamber 110 is also returned to the original one. Ink is accordingly stored into the pressure chamber 110 again. In this way, a desired image is printed on a paper.

Figure 13A:
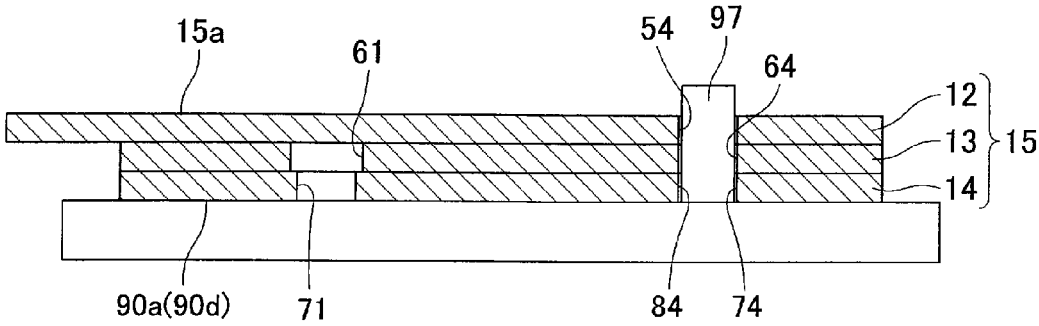
FIG. 13A is a view for explaining a step of laminating an ink supply block during a manufacturing process of the ink-jet head shown in FIG. 1.
Figure 13B:
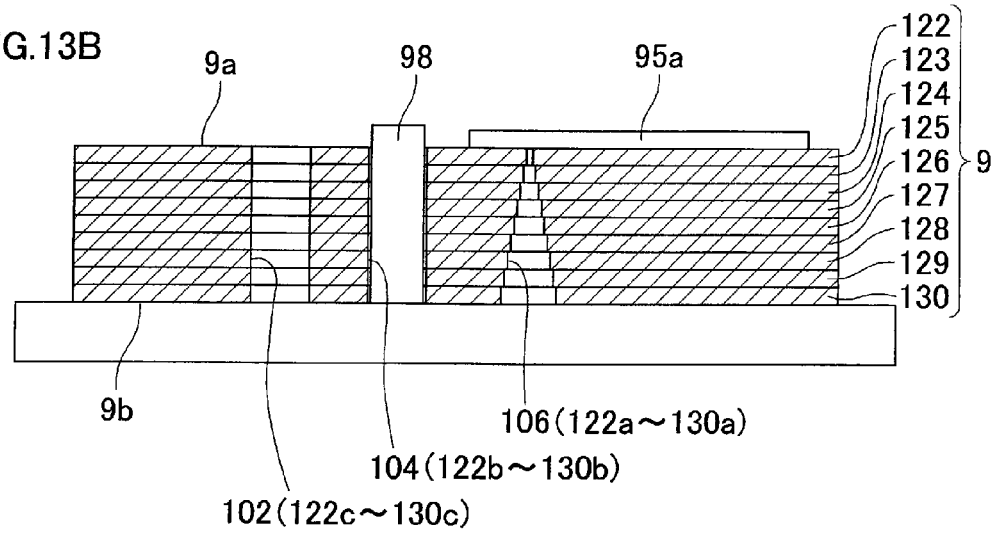
FIG. 13B is a view for explaining a step of laminating a passage unit during the manufacturing process of the ink-jet head shown in FIG. 1.

Next, a process of manufacturing the ink-jet head 1 will be described with reference to FIGS. 13A to 13C.

In order to manufacture the ink supply block 15, first, three metal plates are subjected to an etching process using a patterned photoresist as a mask, to prepare the three plates 12 to 14 as shown in FIGS. 3C to 3E. Then, as shown in FIG. 13A, the insertion pin 97 is inserted through the reference holes 54, 64, and 74 formed in the respective plates 12 to 14, and in this condition the three plates 12 to 14 are laminated and positioned with each other. The reference holes 54, 64, and 74 have the same diameter. Therefore, accurate positioning can be made by fitting therein the insertion pin 97 adapted to interfit with the reference holes 54, 64, and 74. At this time, an epoxy-base thermosetting adhesive is interposed between the respective plates 12 to 14. Then, the three plates 12 to 14 are heated under pressure to not lower than a curing temperature of the thermosetting adhesive. As a result, the thermosetting adhesive is cured to bond the three plates 12 to 14 to each other, thus forming the ink supply block 15.

In order to manufacture the head main body 2, on the other hand, nine metal plates are subjected to an etching process using a patterned photoresist as a mask, to prepare the nine plates 122 to 130 as shown in FIG. 7. Then, as shown in FIG. 13B, the insertion pin 98 is inserted through the reference holes 122*b* to 130*b* formed in the respective plates 122 to 130, and in this condition the nine plates 122 to 130 are laminated and positioned with each other. The reference holes 122*b* to 130*b* formed in the respective plates 122 to 130 have the same diameter. Therefore, substantially accurate positioning can be made by fitting therein the insertion pin 98 adapted to interfit with the reference holes 122*b* to 130*b*.

Further, highly accurate positioning of the plates 122 to 130 is made using the lamination check holes 122*a* to 130*a*. More specifically, when laminating the cover plate 129 on the lowermost nozzle plate 130 for example, the lamination check hole 129*a* of the cover plate 129 and the lamination check hole 130*a* of the nozzle plate 130 are brought into axial alignment to thereby make highly accurate positioning of the plates 129 and 130. At this time, an epoxy-base thermosetting adhesive is interposed between the respective plates 122 to 130. After laminated, the plates 122 to 130 are heated under pressure to not lower than a curing temperature of the thermosetting adhesive. As a result, the nine plates 122 to 130 are bonded to each other, thus forming the passage unit 9. Then, the actuator unit 21 prepared in a separate step and the filter films 95*a* and 95*b* are fixed to the support face 9*a* of the passage unit 9 with an adhesive, thus forming the head main body 2.

Since a step of preparing the ink supply block 15 and a step of preparing the head main body 2 are performed separately, either one of them may precede the other or alternatively they may be performed simultaneously.

Figure 13C:
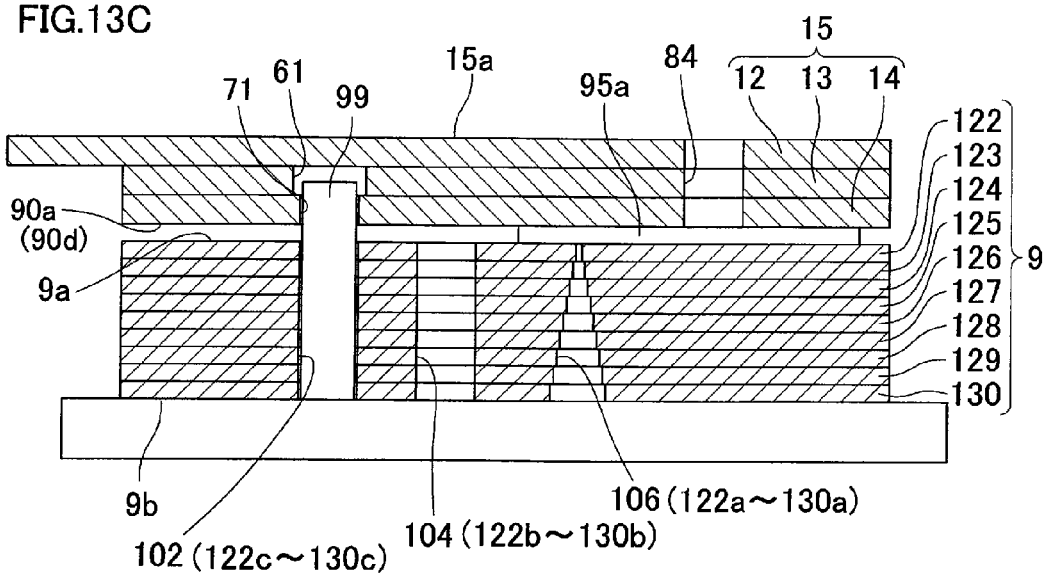
FIG. 13C is a view for explaining a step of laminating the passage unit and the ink supply block during the manufacturing process of the ink-jet head shown in FIG. 1.

Thereafter, the FPC 6 and the actuator unit 21 are electrically connected to each other, and then the insertion pin 99 is inserted through the through hole 102 formed in the passage unit 9 and the positioning hole 71 formed in the plate 14 of the ink supply block 15, as shown in FIG. 13C. A distal end of the insertion pin 99 locates within the relief hole 61 formed in the plate 13 of the ink supply block 15. At this time, the passage unit 9 and the ink supply block 15 are positioned with each other in such a manner that the inflow openings 101 of the passage unit 9 and the outflow openings 88 of the ink supply block 15 are connected through the filter films 95*a* and 95*b*. Here, through hole 102 and the positioning hole 71 have the same diameter. Therefore, accurate positioning can be made by fitting therein the insertion pin 99 adapted to interfit with the through hole 102 and the positioning hole 71.

At this time, an epoxy-base thermosetting adhesive is interposed between the bond faces 90*a* to 90*d* of the protrusions 89*a* to 89*d* of the ink supply block 15 and regions of the filter films 95*a* and 95*b*, which are disposed on the support face 9*a* of the passage unit 9, other than the filter regions 96. Subsequently, the passage unit 9 and the ink supply block 15 are heated under pressure to not lower than a curing temperature of the thermosetting adhesive. As a result, the thermosetting adhesive is cured to bond the passage unit 9 and the ink supply block 15 to each other through the filter films 95*a* and 95*b*.

In this embodiment, in a state where the passage unit 9 and the ink supply block 15 are positioned with each other, the through hole 84 formed in the ink supply block 15 is, in a plan view, at a position different from positions of the through holes 102, 104, and 106 formed in the passage unit 9, as shown in FIG. 13C. To be more specific, the through hole 102 of the passage unit 9, the through hole 104 of the passage unit 9, the through hole 106 of the passage unit 9, and the through hole 84 of the ink supply block 15 are placed in this sequence starting from the longitudinal end of the passage unit 9 and the ink supply block 15 toward a longitudinal center thereof, i.e., from left to right in FIG. 13C. As described above, among the through holes 102, 104, and 106 of the passage unit 9, the through hole 106, which is the one most distant from the longitudinal end of the passage unit 9, has its upper end covered with the region of the filter film 95*a* other than the filter region 96. Moreover, as shown in FIG. 13C, the through hole 84 of the ink supply block 15 has its lower end covered with the region of the filter film 95*a* other than the filter region 96.

Further, the ink introduction block 11, which is separately prepared through injection molding or the like and provided with the films 41, 42 and the filter 37, is fixed to the ink supply block 15 by screws, thus forming the reservoir unit 3. In addition, the substrate 4 is engaged with the hooks 26 of the ink introduction block 11, and thus fixed to the reservoir unit 3. Finally, an end of the FPC 6 not connected to the actuator unit 21 is connected to the connector 5*a* of the substrate 4. In this way, the ink-jet head 1 made up of the reservoir unit 3, the head main body 2, and the substrate 4 is manufactured.

As thus far described above, the ink-jet head 1 of this embodiment includes the passage unit 9, the filter films 95*a*, and the ink supply block 15. The passage unit 9 has, on its upper face or the support face 9*a*, the inflow openings 101 through which ink flows. The filter films 95*a* are attached to the support face 9*a* so as to cover the inflow openings 101 of the passage unit 9. The ink supply block 15 has the inlet hole 53 into which ink is injected and the outflow openings 88 from which ink flows out. The outflow openings 88 are connected to the inflow openings 101 of the passage unit 9 through the filter films 95*a*. The through holes 102, 104, and 106 are formed through the passage unit 9 from its lower face or the ink ejection face 9*b* to the support face 9*a*. The through holes 84 are formed through the ink supply block 15, from its lower face or the bond faces 90*a* to 90*d* connected to the filter films 95*a*, to its upper face or the ink inlet face 15*a*. The filter films 95*a* inhibit communication between the through holes 84 formed in the ink supply block 15 and the through holes 102, 104, and 106 formed in the passage unit 9. Accordingly, ink cannot go from the ink ejection face 9*b* to the ink inlet face 15*a* through the through holes 102, 104, 106, and 84. This can prevent that ink having reached the ink inlet face 15*a* adheres to the FPC 6 which extends upward along the side face of the ink supply block 15, or ink having reached the ink inlet face 15*a* flows along the FPC 6 and adhere to the actuator unit 21. Consequently, electrical failure can be suppressed.

In the ink-jet head 1 of this embodiment, the lower openings of the through holes 84 formed in the ink supply block 15 are covered with the regions of the filter films 95*a*, which are disposed on the support face 9*a* of the passage unit 9, other than the filter regions 96 that are opposed to the inflow openings 101. Accordingly, the filter films 95*a* block communication between the through holes 102, 104, and 106 formed in the passage unit 9 and the through hole 84 formed in the ink supply block 15. This can surely prevent ink from going from the ink ejection face 9*b* to the ink inlet face 15*a* through the through holes 102, 104, 106, and 84.

In the ink-jet head 1 of this embodiment, many filter holes 96*a* are formed only in the region of the filter film 95*a* opposed to the inflow opening 101. That is, the filter holes 96*a* are not formed in a region of the filter film 95*a* covering the through hole 84. Accordingly, the filter films 95*a* surely block communication between the through holes 102, 104, and 106 formed in the passage unit 9 and the through hole 84 formed in the ink supply block 15. This can more surely prevent ink from going from the ink ejection face 9*b* to the ink inlet face 15*a* through the through holes 102, 104, 106, and 84.

In the ink-jet head 1 of this embodiment, the through holes 84 formed in the ink supply block 15 are, in a plan view, at positions different from positions of the through holes 102, 104, and 106 formed in the passage unit 9. This can still more surely prevent ink from going from the ink ejection face 9*b* to the ink inlet face 15*a* through the through holes 102, 104, 106, and 84.

In the ink-jet head 1 of this embodiment, the passage unit 9 and the ink supply block 15 have elongated shapes in a plan view, and the through holes 102, 104, 106, and 84 are formed at the both longitudinal end portions of the passage unit 9 and the ink supply block 15. Accordingly, a relatively large actuator unit 21 can be disposed between the through holes 102, 104, 106, and 84 which are formed in the both longitudinal end portions of the passage unit 9 and the ink supply block 15. In addition, actuator units 21 each having a trapezoidal shape are disposed concentratedly in the vicinity of a longitudinal center, so that there are nonprint regions between the actuator units 21 and the through holes 102, 104, and 106. Therefore, ink can hardly go from the ink ejection face 9*b* into the through holes 102, 104, and 106.

In the ink-jet head 1 of this embodiment, the four actuator units 21 disposed on the support face 9*a* of the passage unit 9 are arranged in the longitudinal direction, in such a manner that actuator units 4 neighboring each other in the longitudinal direction have their end portions with respect to the longitudinal direction overlap each other with respect to the longitudinal direction on the support face 9*a*. The filter film 95*a* is attached between a longitudinal end of the passage unit 9 and the actuator unit 21 closest to this longitudinal end. This can realize a relatively long line without increasing a size of each actuator unit 21.

In the ink-jet head 1 of this embodiment, the filter film 95*a* covers the through hole 106 which is, among the through holes 102, 104, and 106 formed in the passage unit 9, the one most distant from the longitudinal end of the passage unit 9 in a plan view. That is, the through hole 106, which is most adjacent to the actuator unit 21 and therefore most easy for ink adhering to the ink ejection face 9*b* to enter, can be covered. This can prevent ink from going into a region between the passage unit 9 and the ink supply block 15 where the actuator units 21 are disposed.

In the ink-jet head 1 of this embodiment, the ink supply block 15 has the opposing face 15*b* facing toward the same direction as the bond faces 90*a* to 90*d* are while being spaced apart from the support face 9*a*, so that the opposing face 15*b* is opposed to the actuator units 21 with respect to a direction perpendicular to the ink ejection face 9*b*. This enables the ink supply block 15 to be disposed also in a region opposed to the actuator units 21. An amount of ink stored in the ink supply block 15 can be increased accordingly, and therefore insufficient ink supply to the passage unit 9 hardly occurs.

In the above-described embodiment, the lower openings of the through holes 84 formed in the ink supply block 15 and the upper openings of the through holes 106 formed in the passage unit 9 are covered with the regions of the filter films 95*a* other than the filter regions 96. However, this is not limitative. For example, it may also be possible that either one of the through hole 84 and the through hole 106 is covered with the filter films 95*a*. Here, it is preferable that, in a case where the through hole 106 alone is covered with the filter films 95*a* and the through hole 84 is not covered with the filter film 95*a*, the through hole 84 locates on a side opposite to the through holes 102 and 104 with respect to the through hole 106. Thereby, even if ink adhering to the ink ejection face 9*b* reaches the support face 9*a* through the through holes 102 and 104, the ink hardly goes further into the through hole 84 to reach the ink inlet face 15*a*. In addition, the through holes 102, 104, 106, and 84 may not necessarily be covered with the filter film 95*a*, as long as the filter film 95*a* blocks communication between the through hole 84 and the through holes 102, 104, and 106.

In the above-described embodiment, many filter holes 96*a* are formed only in the region of the filter film 95*a* opposed to the inflow opening 101. However, it may not be necessary that the filter holes 96*a* are formed in an entire region of the filter film 95*a*. Even in a case where the filter holes 96*a* are formed in the entire region of the filter film 95*a*, by using an adhesive for fixing the filter film 95*a* to the support face 9*a* of the passage unit 9 and for fixing the filter film 95*a* to the bond face 90*a* to 90*d* of the ink supply block 15, filter holes 96*a* formed in a region not opposed to the inflow opening 101 can be filled with the adhesive. Therefore, communication between the through holes 102, 104, and 106 and the through hole 84 can be blocked by the filter film 95*a*.

In the above-described embodiment, the through holes 84 formed in the ink supply block 15 are, in a plan view, at positions different from positions of the through holes 104 and 106 formed in the passage unit 9. However, the through holes 84 and the through holes 104 or 106 may be at the same position in a plan view, as long as the filter films 95*a* are disposed between them.

In the above-described embodiment, the passage unit 9 and the ink supply block 15 have elongated shapes in a plan view, and the through holes 102, 104, 106, and 84 are formed at the both longitudinal end portions of the passage unit 9 and the ink supply block 15. However, this is not limitative. A shape of the passage unit 9 and a shape of the ink supply block 15 are not limited to an elongated one.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet head comprising:

a passage unit that is made up of a plurality of plate members laminated with each other, and includes a plurality of individual ink passages each including a pressure chamber and extending to an ink ejection port from which ink is ejected, an ink ejection face formed with a plurality of the ink ejection ports, and a support face formed with an inflow opening through which ink flows in and facing in a direction opposite to a facing direction of the ink ejection face;

a filter film that is attached to the support face so as to cover the inflow opening, to thereby filter ink that passes through the inflow opening;

a piezoelectric actuator that is attached to the support face and applies ejection energy to ink contained in the pressure chambers;

a wire member formed with a plurality of wires that are electrically connected to the piezoelectric actuator and supply an ejection signal to the piezoelectric actuator; and an ink supply block that is made up of a plurality of plate members laminated with each other, and includes a bond face and an ink inlet face, the bond face being formed with an outflow opening through which ink flows out and being bonded to the filter film in such a manner that the inflow opening and the outflow opening are connected through the filter film, the ink inlet face being formed with an inlet hole into which ink is injected and facing in a direction opposite to a facing direction of the bond face, wherein:

the passage unit is provided with a through hole that extends in a direction perpendicular to the ink ejection face to connect the ink ejection face and the support face;

the ink supply block is provided with a through hole that extends in the direction perpendicular to the ink ejection face to connect the bond face and the ink inlet face; and the filter film blocks communication between the through hole provided in the passage unit and the through hole provided in the ink supply block.

2. The ink-jet head according to claim 1, wherein a portion of the filter film not opposed to the inflow opening covers at least either one of the through hole provided in the passage unit and the through hole provided in the ink supply block.

3. The ink-jet head according to claim 2, wherein:

the filter film has a filter region that is opposed to the inflow opening and in which many holes are formed; and a portion of the filter film other than the filter region covers at least either one of the through hole provided in the passage unit and the through hole provided in the ink supply block.

4. The ink-jet head according to claim 1, wherein the through hole provided in the passage unit and the through hole provided in the ink supply block are at different positions in a plan view.

5. The ink-jet head according to claim 1, wherein:

the passage unit and the ink supply block have elongated shapes in a plan view;

one or more through holes are provided at each longitudinal end portion of the passage unit in a plan view;

one or more through holes are provided at each longitudinal end portion of the ink supply block in a plan view; and the piezoelectric actuator is disposed on the support face, in such a manner that the piezoelectric actuator locates in a region corresponding to a space between, among the one or more through holes provided at one longitudinal end portion of the passage unit and at one longitudinal end portion of the ink supply block, the through hole most distant from the one longitudinal end and, among the one or more through holes provided at the other end portions, the through hole most distant from the other end.

6. The ink-jet head according to claim 5, comprising a plurality of the piezoelectric actuators, wherein:

the plurality of the piezoelectric actuators are arranged in the longitudinal direction in such a manner that piezoelectric actuators neighboring each other in the longitudinal direction have their longitudinal end portions overlap each other within the support face with respect to the longitudinal direction; and the filter film is attached between an end of the passage unit with respect to the longitudinal direction and the piezoelectric actuator closest to the end.

7. The ink-jet head according to claim 6, wherein:

a plurality of the through holes are provided at each of the both longitudinal end portions of the passage unit; and the filter film covers, among the plurality of the through holes provided at the longitudinal end portion of the passage unit, the through hole most distant from the end.

8. The ink-jet head according to claim 7, wherein, in a plan view, the through hole provided in the ink supply block locates on the side opposite to the longitudinal end with respect to the through hole that is provided at the longitudinal end portion of the passage unit and besides covered with the filter film.

9. The ink-jet head according to claim 7, wherein, in a plan view, the filter film extends to both widthwise end portions of the passage unit.

10. The ink-jet head according to claim 1, wherein the ink supply block further includes an opposing face that faces in the same direction as a facing direction of the bond face while being spaced apart from the support face, in such a manner that the opposing face is opposed to the piezoelectric actuator with respect to a direction perpendicular to the ink ejection face.

* * * * *